US009295876B2

(12) United States Patent
Singh

(10) Patent No.: US 9,295,876 B2
(45) Date of Patent: Mar. 29, 2016

(54) FOOT EXERCISE DEVICE

(71) Applicant: Ashok K. Singh, Ellicottcity, MD (US)

(72) Inventor: Ashok K. Singh, Ellicottcity, MD (US)

( * ) Notice: Subject to any disclaimer, the term of this patent is extended or adjusted under 35 U.S.C. 154(b) by 178 days.

(21) Appl. No.: 13/865,353

(22) Filed: Apr. 18, 2013

(65) Prior Publication Data

US 2014/0315694 A1 Oct. 23, 2014

(51) Int. Cl.

| | |
|---|---|
| ***A63B 21/00*** | (2006.01) |
| ***A63B 23/08*** | (2006.01) |
| ***A63B 21/02*** | (2006.01) |
| ***A63B 21/05*** | (2006.01) |
| ***A63B 23/035*** | (2006.01) |
| *A63B 23/00* | (2006.01) |

(52) U.S. Cl.

CPC ..... *A63B 23/085* (2013.01); *A63B 21/023* (2013.01); *A63B 21/05* (2013.01); *A63B 21/1465* (2013.01); *A63B 21/4033* (2015.10); *A63B 23/03508* (2013.01); *A63B 2023/006* (2013.01); *A63B 2208/0204* (2013.01); *A63B 2225/09* (2013.01)

(58) Field of Classification Search

CPC ..... A63B 21/00

USPC ..... 482/49, 51, 52, 141, 121, 110, 112

See application file for complete search history.

(56) References Cited

U.S. PATENT DOCUMENTS

| | | | | |
|---|---|---|---|---|
| 3,472,508 | A | 10/1969 | Baker et al. | |
| 4,371,160 | A | 2/1983 | Shooltz | |
| 4,998,720 | A | 3/1991 | Kim | |
| D325,968 | S | 5/1992 | Nofsinger | |
| 5,127,892 | A | 7/1992 | Sawdon | |
| 5,299,995 | A | 4/1994 | Ko | |
| 5,421,800 | A * | 6/1995 | Mullen | 482/121 |
| 5,897,464 | A | 4/1999 | Mcleod | |
| 6,709,368 | B1 | 3/2004 | Chue | |
| D596,246 | S | 7/2009 | Nofsinger | |
| 7,645,221 | B1 | 1/2010 | Curry | |
| 2006/0240955 | A1 | 10/2006 | Pu | |
| 2011/0224049 | A1 | 9/2011 | Farrell | |

* cited by examiner

*Primary Examiner* — Jerome W Donnelly
(74) *Attorney, Agent, or Firm* — Richard L. Miller

(57) ABSTRACT

An exercise device that includes a main base and a pair of resistance members. The main base rests on a support surface. The pair of resistance members are replaceably attached to the main base to allow the device to be portable, are length adjustably attached to the main base to allow the device to be length adjustable, are resistance adjustable so as to allow the device to be resistance adjustable, allow exercising of both feet simultaneously without having to have the feet physically attached thereto, are activated by weight of the user, and are disposed on opposite sides of the main base so as to allow the feet to be positioned in front of each other during exercising both feet simultaneously so as to work in opposition to each other by working the toe portion of one foot simultaneously with the heel portion of the other foot.

56 Claims, 5 Drawing Sheets

FOOT EXERCISE DEVICE

1. BACKGROUND OF THE INVENTION

A. Field of the Invention

The embodiments of the present invention relate to a foot exercising device, and more particularly, the embodiments of the present invention relate to a portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe of one foot of the user simultaneously with the heel of the other foot of the user.

B. Description of the Prior Art

Numerous innovations for foot exercising devices have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe of one foot of the user simultaneously with the heel of the other foot of the user.

(1) U.S. Pat. No. 3,472,508 to Baker et al.

U.S. Pat. No. 3,472,508—issued to Baker et al. on Oct. 14, 1969 in U.S. class 482 and subclass 79—teaches a foot and calf exercising device that is releasably held on the foot by straps. The device rests on the floor and the exerciser's foot engages the top surface thereof so that the ball of the foot is higher than the heel. The higher front and bottom of the device join in a curve so that the device can be rocked forwardly and backwardly to stretch and release the muscles of the lower leg.

(2) U.S. Pat. No. Des. 325,968 to Nofsinger.

U.S. Pat. No. Des. 325,968—issued to Nofsinger on May 5, 1992 in U.S. class D21 and subclass 685—teaches the ornamental design for a rehabilitation block.

(3) U.S. Pat. No. 5,127,892 to Sawdon.

U.S. Pat. No. 5,127,892—issued to Sawdon on Jul. 7, 1992 in U.S. class 482 and subclass 79—teaches an in situ foot exercise shoe for enhancing the in-place exercise of the foot of a person, particularly, the elderly and those afflicted with various abnormalities of the lower extremities, which require exercise without actual walking or running. The apparatus includes a shoe that enhances sliding movement in a to-and-fro path of travel. The shoe includes a planar slide for sliding in a to-and-fro reciprocal path of travel, and a mechanism for coupling the slide to the underside of the foot. The slide includes a sole having a smooth uninterrupted planar bottom surface.

(4) U.S. Pat. No. 5,299,995 to Ko.

U.S. Pat. No. 5,299,995—issued to Ko on Apr. 5, 1994 in U.S. class 482 and subclass 52—teaches a foot exercising apparatus including a main support adjustable mounted on a base plate in a sloping position, two linked sliding blocks driven by pedals with the legs to slide alternatively up and down in two tracks on two opposite long sides of the main support.

(5) U.S. Pat. No. 6,709,368 to Chue.

U.S. Pat. No. 6,709,368—issued to Chue on Mar. 23, 2004 in U.S. class 482 and subclass 79—teaches an exercise devise that can be used by anyone for simulating walking while sitting down. Including two pedals that move in opposition to one another as one foot presses down, while the other is pushed up, the device is placed under the feet while sitting in a chair. By turning clockwise, a resistance dial located on a stem adjusts resistance. A straight metal axle at the rear of the device serves as an axis about which two pedals rotate, and furnishes support through the attached feet. A mechanism of resistance is provided by opposition against two arc-shaped wedges offset by an angle resulting in one pedal rising as the other falls. Each end of a curved axle in the front provides support. The straight axle in the back is connected to the curved axle in the front by a central housing on top of which is positioned the resistance dial.

(6) United States Patent Application Publication Number 2006/0240955 to Pu.

United States Patent Application Publication Number 2006/0240955—published to Pu on Oct. 26, 2006 in U.S. class 482 and subclass 79—teaches a foot exercise device that includes a base having a front handle, a frame attached to a rear portion of the base and having an upper channel, and two or more lower cavities communicating with the upper channel. A platform includes a number of projections for massaging feet of users, and includes a front portion pivotally coupled to the base, and includes a rear portion having one or more pegs slidable along the upper channel of the frame, and selectively engageable in either of the lower cavities of the frame. The platform is adjustable relative to the base to different inclination when the peg of the platform is adjustably engaged in either of the lower cavities of the frame.

(7) U.S. Pat. No. Des. 596,246 to Nofsinger.

U.S. Pat. No. Des. 596,246—issued to Nofsinger on Jul. 14, 2009 in U.S. class D21 and subclass 685—teaches the ornamental design for a therapeutic foot exercise block.

(8) United States Patent Application Publication Number 2011/0224049 to Farrell.

United States Patent Application Publication Number 2011/0224049—published to Farrell on Sep. 15, 2011 in U.S. class 482 and subclass 79—teaches a device for exercising a foot, which has a base onto which the foot to be exercised is located, and an upper. A number of resilient members are secured to the upper, and on moving the foot between an extended position and a retracted position, the resilient members provide a resistive force on the foot, which opposes the movement of the foot between the extended and retracted positions.

It is apparent that numerous innovations for foot exercising devices have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe of one foot of the user simultaneously with the heel of the other foot of the user.

2. SUMMARY OF THE INVENTION

Thus, an object of the embodiments of the present invention is to provide a portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe of one foot of the user simultaneously with the heel of the other foot of the user, which avoids the disadvantages of the prior art.

Briefly stated, another object of the embodiments of the present invention is to provide a portable, length-adjustable, and resistance adjustable exercise device that allows exercising of both feet of a user simultaneously without having to have the feet of the user physically attached thereto, uses weight of the user to activate resistance, and allows the feet of the user to be positioned in front of each other during exercising both feet simultaneously so as to work in opposition to each other by working the toe of one foot of the user simultaneously with the heel of the other foot of the user. The portable, length-adjustable, and resistance adjustable exercise device includes a main base and a pair of resistance members. The main base rests on a support surface. The pair of resistance members are replaceably attached to the main base so as to allow the portable, length-adjustable, and resistance adjustable exercise device to be portable, are length adjustably attached to the main base so as to allow the portable, length-adjustable, and resistance adjustable exercise device to be length adjustable, are resistance adjustable so as to allow the portable, length-adjustable, and resistance adjustable exercise device to be resistance adjustable, allow exercising of both feet of the user simultaneously without having to have the feet of the user physically attached thereto, are activated by the weight of the user, and are disposed on opposite sides of the main base so as to allow the feet of the user to be positioned in front of each other during exercising both feet simultaneously so as to work in opposition to each other by working the toe of the one foot of the user simultaneously with the heel of the other foot of the user.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

Figure 3:
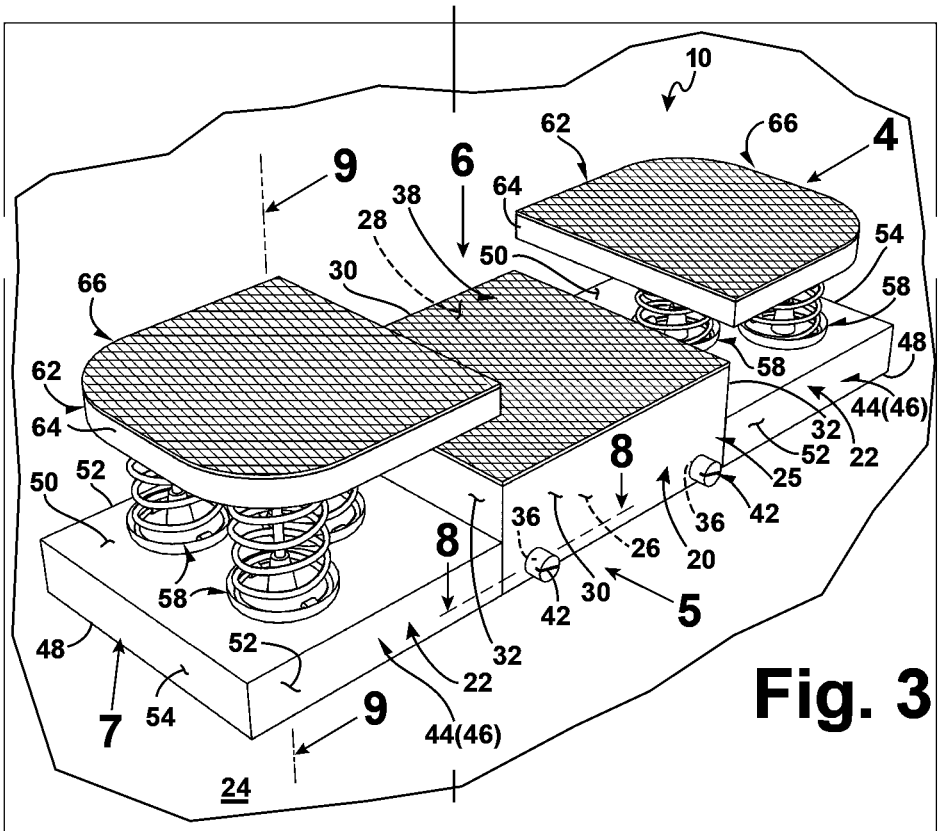
FIG. 3 is an enlarged diagrammatic perspective view of the portable, length-adjustable, and resistance adjustable exercise device of the embodiments of the present invention identified by ARROW 3 in FIGS. 1 and 3.
Figure 4:
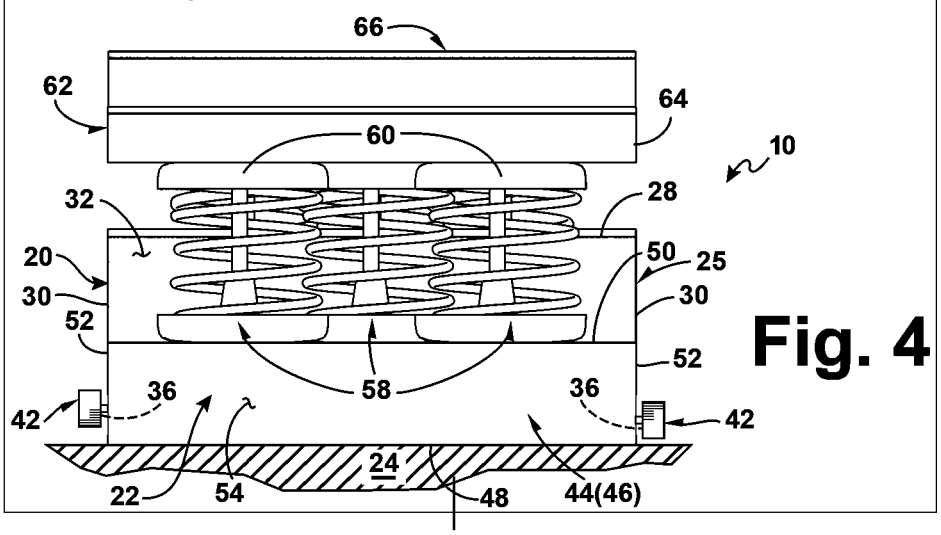
FIG. 4 is an enlarged diagrammatic end view taken generally in the direction of ARROW 4 in FIG. 3 of the portable, length-adjustable, and resistance adjustable exercise device of the embodiments of the present invention.
Figures 5, 6:
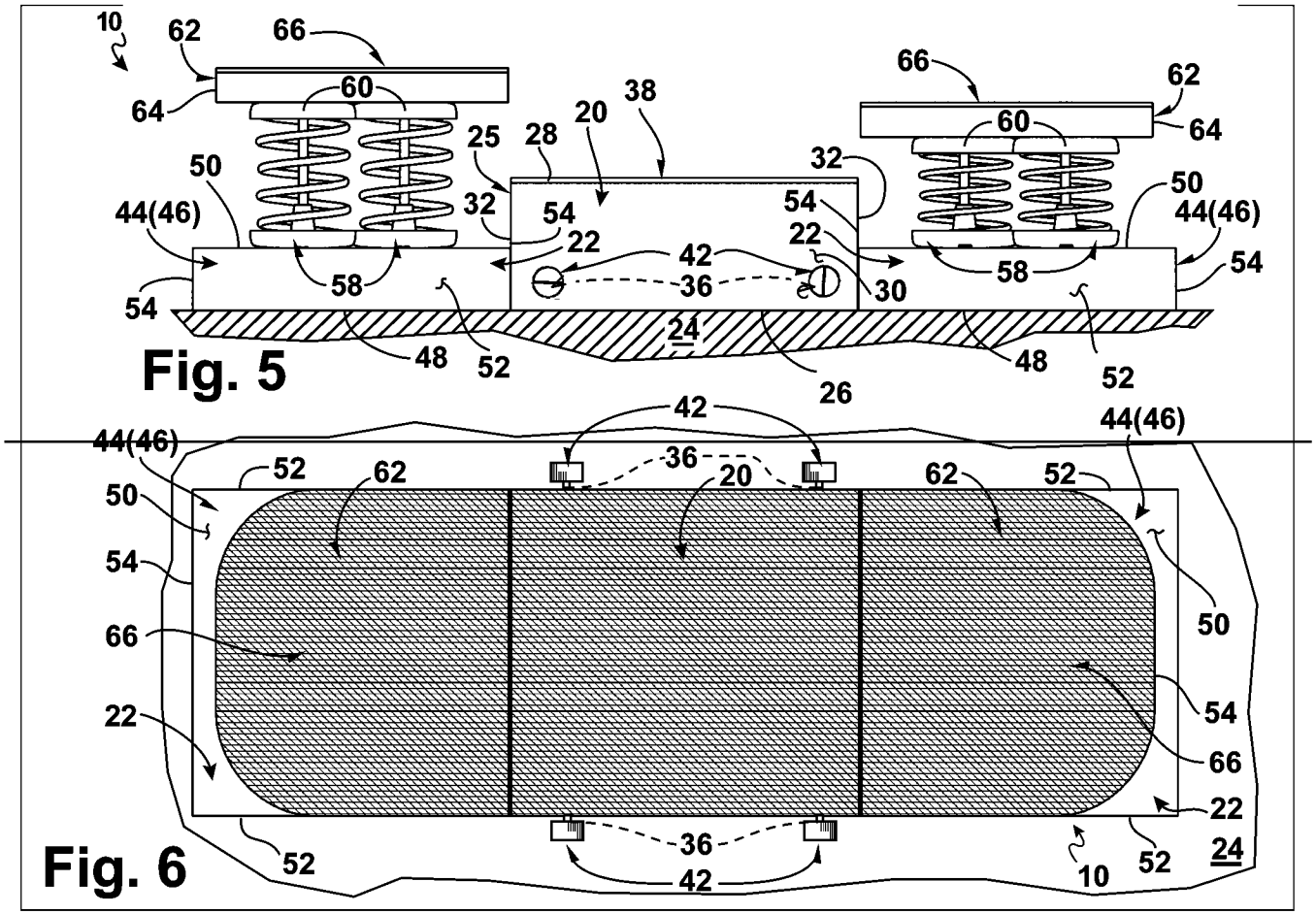
FIG. 5 is an enlarged diagrammatic side elevational view taken generally in the direction of ARROW 5 in FIG. 3 of the portable, length-adjustable, and resistance adjustable exercise device of the embodiments of the present invention.
FIG. 6 is an enlarged diagrammatic top plan view taken generally in the direction of ARROW 6 in FIG. 3 of the portable, length-adjustable, and resistance adjustable exercise device of the embodiments of the present invention.
Figure 7:
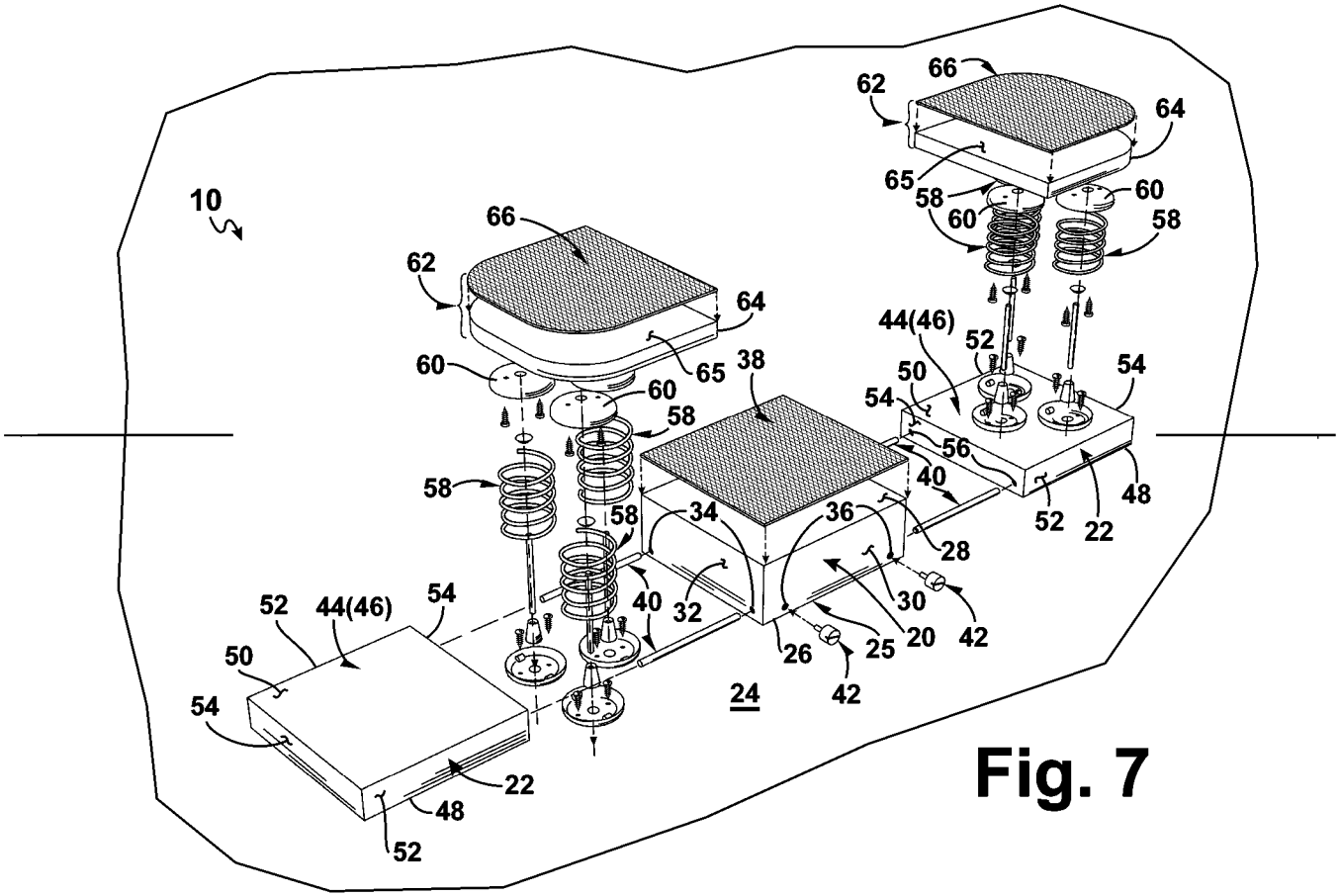
FIG. 7 is an exploded and reduced diagrammatic perspective view of the portable, length-adjustable, and resistance adjustable exercise device of the embodiments of the present invention identified by ARROW 7 in FIG. 3.
Figure 8:
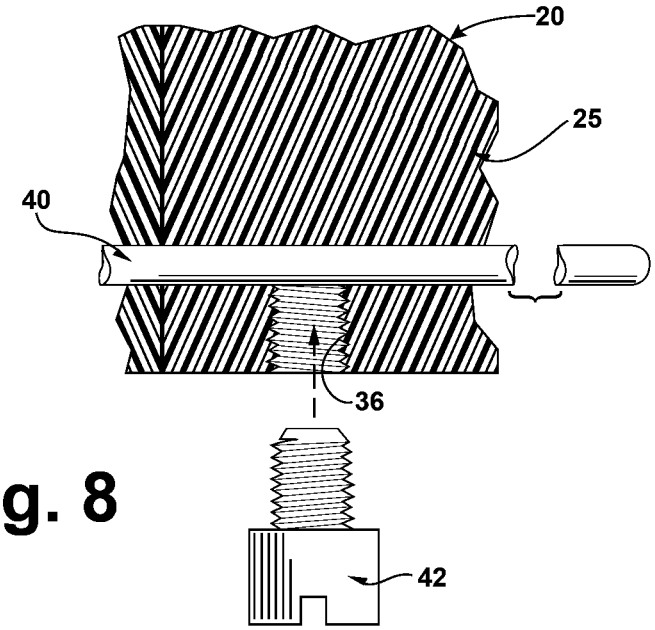
Figure 9:
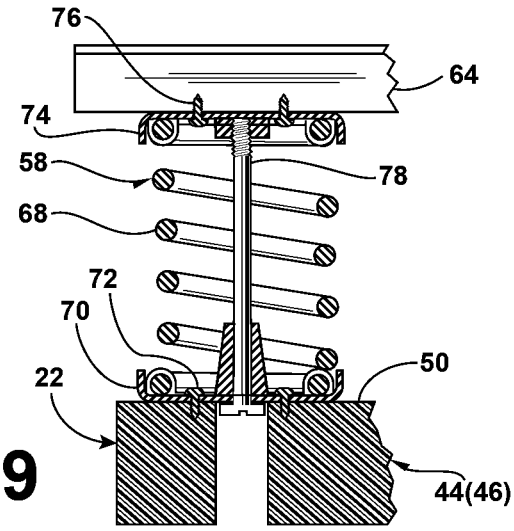

FIG. 8 is an enlarged diagrammatic cross sectional view taken along LINE 8-8 in FIG. 3 of the length adjustment apparatus of the portable, length-adjustable, and resistance adjustable exercise device of the embodiments of the present invention; and FIG. 9 is an enlarged diagrammatic cross sectional view taken along LINE 9-9 in FIG. 3 of the resistance adjustment apparatus of the portable, length-adjustable, and resistance adjustable exercise device of the embodiments of the present invention.

4. LIST OF REFERENCE NUMERALS UTILIZED IN THE FIGURES OF THE DRAWING

A. Introductory.

10 portable, length-adjustable, and resistance adjustable exercise device of embodiments of present invention for allowing exercising of both feet 12 of user 14 simultaneously without having to have feet 12 of user 14 physically attached thereto, for using weight of user 14 for activating resistance, and for allowing feet 12 of user 14 to be positioned in front of each other during exercising both feet 12 simultaneously so as to work in opposition to each other by working toe 16 of one foot 12 of user 14 simultaneously with heel 18 of other foot 12 of user 14

12 feet of user 14

14 user

16 toe of one foot 12 of user 14

18 heal of other foot 12 of user 14

B. Overall Configuration of Portable, Length-Adjustable, and Resistance Adjustable Exercise Device 10.

20 main base for resting on support surface 24

22 pair of resistance members for allowing portable, length-adjustable, and resistance adjustable exercise device 10 to be portable, for allowing portable, length-adjustable, and resistance adjustable exercise device 10 to be length adjustable, for allowing portable, length-adjustable, and resistance adjustable exercise device 10 to be resistance adjustable, for allowing exercising of both feet 12 of user 14 simultaneously without having to have feet 12 of user 14 physically attached thereto, for activating by weight of user 14, and for allowing feet 12 of user 14 to be positioned in front of each other during exercising both feet 12 simultaneously so as to work in opposition to each other by working toe 16 of one foot 12 of user 14 simultaneously with heel 18 of other foot 12 of user 14

24 support surface

C. Specific Configuration of Main Base 20.

25 rectangular-parallelepiped-shaped block of main base 20

26 lower surface of rectangular-parallelepiped-shaped block 25 of main base 20

28 upper surface of rectangular-parallelepiped-shaped block 25 of main base 20

30 pair of axial side surfaces of rectangular-parallelepiped-shaped block 25 of main base 20

32 pair of lateral side surfaces of rectangular-parallelepiped-shaped block 25 of main base 20

34 pair of through bores of rectangular-parallelepiped-shaped block 25 of main base 20

36 two pair of threaded blind bores of rectangular-parallelepiped-shaped block 25 of main base 20

38 skid-resistant pad of main base 20 for increasing grip of foot 12 of user 14 thereon

40 two pair of rail rods of main base 20

42 two pair of bolts of main base 20

D. Specific Configuration of Pair of Resistance Members 22.

44 auxiliary base of each resistance member of pair of resistance members 22

46 rectangular-parallelepiped-shaped block of auxiliary base 44 of each resistance member of pair of resistance members 22

48 lower surface of rectangular-parallelepiped-shaped block 46 of auxiliary base 44 of each resistance member of pair of resistance members 22

50 upper surface of rectangular-parallelepiped-shaped block 46 of auxiliary base 44 of each resistance member of pair of resistance members 22

52 pair of axial side surfaces of rectangular-parallelepiped-shaped block 46 of auxiliary base 44 of each resistance member of pair of resistance members 22

54 pair of lateral side surfaces of rectangular-parallelepiped-shaped block 46 of auxiliary base 44 of each resistance member of pair of resistance members 22

56 pair of blind bores of rectangular-parallelepiped-shaped block 46 of auxiliary base 44 of each resistance member of pair of resistance members 22

58 three coil spring assemblies of each resistance member of pair of resistance members 22

60 terminators of three coil spring assemblies 58 of each resistance member of pair of resistance members 22

62 platform of each resistance member of pair of resistance members 22 for working toe 16 of foot 12 of user 14 or heel 18 of foot 12 of user 14

64 thin block of platform 62 of each resistance member of pair of resistance members 22

65 upper surface of thin block 64 of platform 62 of each resistance member of pair of resistance members 22

66 skid-resistant pad of platform 62 of each resistance member of pair of resistance members 22 for increasing grip of foot 12 of user 14 thereon E. Specific Configuration of Three Coil Spring Assemblies 58 of Pair of Resistance Members 22, Respectively.

68 coil spring of each coil spring assembly of three spring assemblies 58 of each resistance member of pair of resistance members 22

70 lower seat of each coil spring assembly of three spring assemblies 58 of each resistance member of pair of resistance members 22

72 screws of lower seat 70 of each coil spring assembly of three spring assemblies 58 of each resistance member of pair of resistance members 22

74 upper seat of each coil spring assembly of three spring assemblies 58 of each resistance member of pair of resistance members 22

76 screws of upper seat 74 of each coil spring assembly of three spring assemblies 58 of each resistance member of pair of resistance members 22

78 stem of each coil spring assembly of three coil spring assemblies 58 of each resistance member of pair of resistance members 22

5. DETAILED DESCRIPTION OF THE PREFERRED EMBODIMENTS

A. Introductory.

Figures 1, 2:
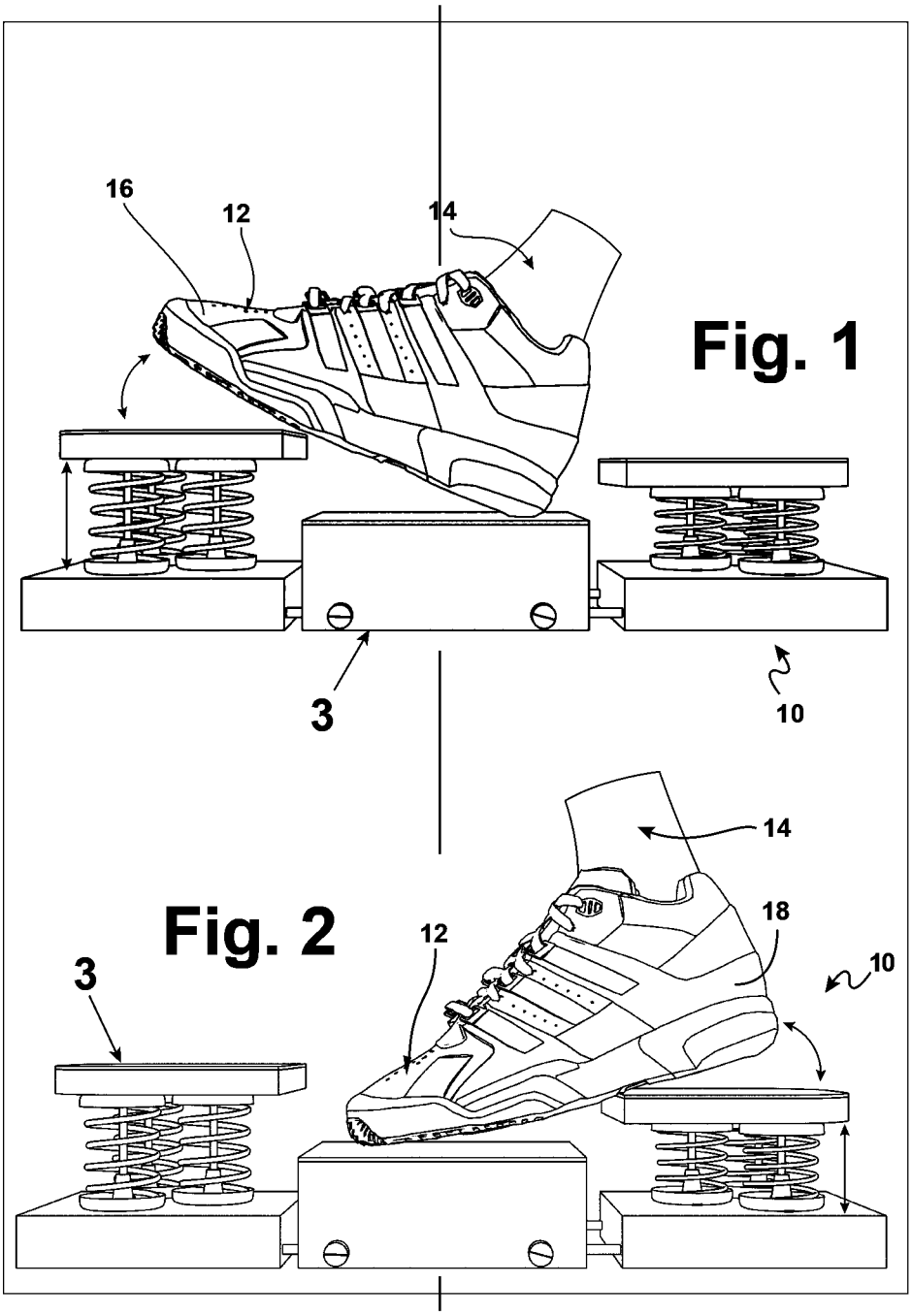
FIG. 1 is a diagrammatic perspective view of the portable, length-adjustable, and resistance adjustable exercise device of the embodiments of the present invention exercising muscles by pressing with the toe portion of one foot of a user without having to have the one foot of the user physically attached thereto and using weight of the user to activate resistance.
FIG. 2 is a diagrammatic perspective view of the portable, length-adjustable, and resistance adjustable exercise device of the embodiments of the present invention exercising muscles by pressing with the heel portion of the other foot of the user without having to have the other foot of the user physically attached thereto and using weight of the user to activate resistance.

Referring now to the figures, in which like numerals indicate like parts, and particularly to FIGS. 1 and 2, which are, respectively, a diagrammatic perspective view of the portable, length-adjustable, and resistance adjustable exercise device of the embodiments of the present invention exercising muscles by pressing with the toe portion of one foot of a user without having to have the one foot of the user physically attached thereto and using weight of the user to activate resistance, and a diagrammatic perspective view of the portable, length-adjustable, and resistance adjustable exercise device of the embodiments of the present invention exercising muscles by pressing with the heel portion of the other foot of the user without having to have the other foot of the user physically attached thereto and using weight of the user to activate resistance, the portable, length-adjustable, and resistance adjustable exercise device of the embodiments of the present invention is shown generally at 10 for allowing exercising of both feet 12 of a user 14 simultaneously without having to have the feet 12 of the user 14 physically attached thereto, for using weight of the user 14 for activating resistance, and for allowing the feet 12 of the user 14 to be positioned in front of each other during exercising both feet 12 simultaneously so as to work in opposition to each other by working the toe 16 of one foot 12 of the user 14 simultaneously with the heel 18 of the other foot 12 of the user 14.

B. Overall Configuration of the Portable, Length-Adjustable, and Resistance Adjustable Exercise Device 10.

The overall configuration of the portable, length-adjustable, and resistance adjustable exercise device 10 can best be seen in FIGS. 3-7, which are, respectively, an enlarged diagrammatic perspective view of the portable, length-adjustable, and resistance adjustable exercise device of the embodiments of the present invention identified by ARROW 3 in FIGS. 1 and 3, an enlarged diagrammatic end view taken generally in the direction of ARROW 4 in FIG. 3 of the portable, length-adjustable, and resistance adjustable exercise device of the embodiments of the present invention, an enlarged diagrammatic side elevational view taken generally in the direction of ARROW 5 in FIG. 3 of the portable, length-adjustable, and resistance adjustable exercise device of the embodiments of the present invention, an enlarged diagrammatic top plan view taken generally in the direction of ARROW 6 in FIG. 3 of the portable, length-adjustable, and resistance adjustable exercise device of the embodiments of the present invention, and an exploded and reduced diagrammatic perspective view of the portable, length-adjustable, and resistance adjustable exercise device of the embodiments of the present invention identified by ARROW 7 in FIG. 3, and as such, will be discussed with reference thereto.

The portable, length-adjustable, and resistance adjustable exercise device 10 comprises a main base 20 and a pair of resistance members 22. The main base 20 is for resting on a support surface 24. The pair of resistance members 22 are replaceably attached to the main base 20 for allowing the portable, length-adjustable, and resistance adjustable exercise device 10 to be portable, are length adjustably attached to the main base 20 for allowing the portable, length-adjustable, and resistance adjustable exercise device 10 to be length adjustable, are resistance adjustable for allowing the portable, length-adjustable, and resistance adjustable exercise device 10 to be resistance adjustable, are for allowing exercising of both feet 12 of the user 14 simultaneously without having to have the feet 12 of the user 14 physically attached thereto, are for activating by the weight of the user 14, and are disposed on opposite sides of the main base 20 for allowing the feet 12 of the user 14 to be positioned in front of each other during exercising both feet 12 simultaneously so as to work in opposition to each other by working the toe 16 of the one foot 12 of the user 14 simultaneously with the heel 18 of the other foot 12 of the user 14.

C. Specific Configuration of the Main Base 20.

The main base 20 comprises a rectangular-parallelepiped-shaped block 25.

The rectangular-parallelepiped-shaped block 25 of the main base 20 has a lower surface 26, an upper surface 28, a pair of axial side surfaces 30, and a pair of lateral side surfaces 32.

The rectangular-parallelepiped-shaped block 25 of the main base 20 further has a pair of through bores 34.

The pair of through bores 34 of the rectangular-parallelepiped-shaped block 25 of the main base 20 are parallel to each other, and extend axially therethrough, in close proximity to, and parallel to, both the pair of axial side surfaces 30 of the rectangular-parallelepiped-shaped block 25 of the main base 20 and the lower surface 26 of the rectangular-parallelepiped-shaped block 25 of the main base 20.

The rectangular-parallelepiped-shaped block 25 of the main base 20 further has two pair of threaded blind bores 36.

The two pair of threaded blind bores 36 of the rectangular-parallelepiped-shaped block 25 of the main base 20 are parallel to each other, extend laterally into the pair of axial side surfaces 30 of the rectangular-parallelepiped-shaped block 25 of the main base 20, respectively, and each associated pair of the two pair of threaded blind bores 36 of the rectangular-parallelepiped-shaped block 25 of the main base 20 are collinear.

The two pair of threaded blind bores 36 of the rectangular-parallelepiped-shaped block 25 of the main base 20 communicate with the pair of through bores 34 of the rectangular-parallelepiped-shaped block 25 of the main base 20, respectively.

The main base 20 further comprises a skid-resistant pad 38.

The skid-resistant pad 38 of the main base 20 overlies the upper surface 28 of the rectangular-parallelepiped-shaped block 25 of the main base 20, and is for increasing grip of the foot 12 of the user 14 thereon.

The main base 20 further comprises two pair of rail rods 40.

The two pair of rail rods 40 of the main base 20 are straight, slender, and elongated.

The two pair of rail rods 40 of the main base 20 move readily in the pair of through bores 34 of the rectangular-parallelepiped-shaped block 25 of the main base 20, respectively.

The main base 20 further comprises two pair of bolts 42.

The two pair of bolts 42 of the main base 20 thread into the two pair of threaded blind bores 36 of the rectangular-parallelepiped-shaped block 25 of the main base 20, respectively.

D. Specific Configuration of the Pair of Resistance Members 22.

The pair of resistance members 22 straddle the main base 20, and are adjacent to the pair of lateral side surfaces 32 of the rectangular-parallelepiped-shaped block 25 of the main base 20, respectively.

Each resistance member 22 comprises an auxiliary base 44.

The auxiliary base 44 of each resistance member 22 is a rectangular-parallelepiped-shaped block 46.

The rectangular-parallelepiped-shaped block 46 of the auxiliary base 44 of each resistance member 22 has a lower surface 48, an upper surface 50, a pair of axial side surfaces 52, and a pair of lateral side surfaces 54. The lower surface 48 of the rectangular-parallelepiped-shaped block 46 of the auxiliary base 44 of each resistance member 22 is for resting on the support surface 24.

The rectangular-parallelepiped-shaped block 46 of the auxiliary base 44 of each resistance member 22 further has a pair of blind bores 56.

The pair of blind bores 56 of the rectangular-parallelepiped-shaped block 46 of the auxiliary base 44 of each resistance member 22 are parallel to each other, extend axially therein from a respective lateral side surface 54 of the rectangular-parallelepiped-shaped block 46 of the auxiliary base 44 of an associated resistance member 22, and are in close proximity to, and parallel to, both the pair of axial side surfaces 52 of the rectangular-parallelepiped-shaped block 46 of the auxiliary base 44 of the associated resistance member 22 and the lower surface 48 of the rectangular-parallelepiped-shaped block 46 of the auxiliary base 44 of the associated resistance member 22.

The pair of blind bores 56 of the rectangular-parallelepiped-shaped block 46 of the auxiliary base 44 of each resistance member 22 align with the pair of through bores 34 of the rectangular-parallelepiped-shaped block 25 of the main base 20, respectively, and slidingly receive the two pair of rail rods 40 of the main base 20, respectively, so as to allow the pair of resistance members 22 to move relative to the main base 20 so as to allow the portable, length-adjustable, and resistance adjustable exercise device 10 to be length adjustable.

Each resistance member 22 further comprises three coil spring assemblies 58.

The three coil spring assemblies 58 of each resistance member 22 extend vertically upwardly from the upper surface 50 of the rectangular-parallelepiped-shaped block 46 of the auxiliary base 44 of an associated resistance member 22 to terminators 60.

Each resistance member 22 further comprises a platform 62. The platform 62 of each resistance member 22 is for working the toe 16 of a foot 12 of the user 14 or the heel 18 of the foot 12 of the user 14.

The platform 62 of each resistance member 22 comprises a thin block 64.

The thin block 64 of the platform 62 of each resistance member 22 is disposed on the terminators 60 of the three coil spring assemblies 58 of an associated resistance member 22, and has an upper surface 65.

The platform 62 of each resistance member 22 further comprises a skid-resistant pad 66.

The skid-resistant pad 66 of the platform 62 of each resistance member 22 overlies the upper surface 65 of the thin block 64 of the platform 62 of an associated resistance member 22, and is for increasing grip of the foot 12 of the user 14 thereon.

E. Interface of the Two Pair of Bolts 42 of the Main Base 20 and the Two Pair of Rail Rods 40 of the Main Base 20.

The interface of the two pair of bolts 42 of the main base 20 and the two pair of rail rods 40 of the main base 20 can best be seen in FIG. 8, which is an enlarged diagrammatic cross sectional view taken along LINE 8-8 in FIG. 3 of the length adjustment apparatus of the portable, length-adjustable, and resistance adjustable exercise device of the embodiments of the present invention, and as such, will be discussed with reference thereto.

The two pair of bolts 42 of the main base 20 tighten down in the two pair of threaded blind bores 36 of the rectangular-parallelepiped-shaped block 25 of the main base 20, respectively, onto the two pair of rail rods 40 of the main base 20, respectively, so as to maintain the two pair of rail rods 40 of the main base 20 at a predetermined position for allowing the portable, length-adjustable, and resistance adjustable exercise device 10 to be length adjustable.

F. Specific Configuration of the Three Coil Spring Assemblies 58 of the Pair of Resistance Members 22, Respectively.

The specific configuration of the three coil spring assemblies 58 of the pair of resistance members 22, respectively, can best be seen in FIG. 9, which is an enlarged diagrammatic cross sectional view taken along LINE 9-9 in FIG. 3 of the resistance adjustment apparatus of the portable, length-adjustable, and resistance adjustable exercise device of the embodiments of the present invention, and as such, will be discussed with reference thereto.

Each coil spring assembly 58 of each resistance member 22 comprises a coil spring 68.

Each coil spring assembly 58 of each resistance member 22 further comprises a lower seat 70.

The lower seat 70 of each coil spring assembly 58 of each resistance member 22 is attached to the upper surface 50 of the rectangular-parallelepiped-shaped block 46 of the auxiliary base 44 of an associated resistance member 22 by screws 72.

The coil spring 68 of each coil spring assembly 58 of each resistance member 22 sits in the lower seat 70 of an associated coil spring assembly 58 of an associated resistance member 22.

Each coil spring assembly 58 of each resistance member 22 further comprises an upper seat 74.

The upper seat 74 of each coil spring assembly 58 of each resistance member 22 is attached to the thin block 64 of the platform 62 of an associated resistance member 22 by screws 76.

The upper seat 74 of each coil spring assembly 58 of each resistance member 22 caps off the coil spring 68 of an associated coil spring assembly 58 of an associated resistance member 22.

Each coil spring assembly 58 of each resistance member 22 further comprises a stem 78.

The stem 78 of each coil spring assembly 58 of each resistance member 22 extends vertically upwardly through the rectangular-parallelepiped-shaped block 46 of the auxiliary base 44 of an associated resistance member 22, through the lower seat 70 of an associated coil spring assembly 58 of the associated resistance member 22, through the coil spring 68 of the associated coil spring assembly 58 of the associated resistance member 22, and into the upper seat 74 of the associated coil spring assembly 58 of the associated resistance member 22.

G. Impressions.

It will be understood that each of the elements described above or two or more together may also find a useful application in other types of constructions differing from the types described above.

While the embodiments of the present invention have been illustrated and described as embodied in a portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe of one foot of the user simultaneously with the heel of the other foot of the user, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe portion of one foot of the user simultaneously with the heel portion of the other foot of the user, said portable, length-adjustable, and resistance adjustable exercise device comprising:

a) a main base; and b) a pair of resistance members;

wherein said main base is for resting on a support surface;

wherein said pair of resistance members are replaceably attached to said main base for allowing said portable, length-adjustable, and resistance adjustable exercise device to be portable;

wherein said pair of resistance members are length adjustably attached to said main base for allowing said portable, length-adjustable, and resistance adjustable exercise device to be length adjustable;

wherein said pair of resistance members are resistance adjustable for allowing said portable, length-adjustable, and resistance adjustable exercise device to be resistance adjustable;

wherein said pair of resistance members are for allowing exercising of both feet of the user simultaneously without having to have the feet of the user physically attached thereto;

wherein said pair of resistance members are for activating by the weight of the user; and wherein said pair of resistance members are disposed on opposite sides of said main base for allowing the feet of the user to be positioned in front of each other during exercising both feet simultaneously so as to work in opposition to each other by working the toe portion of the one foot of the user simultaneously with the heel portion of the other foot of the user, wherein said main base comprises a rectangular-parallelepiped-shaped block.

2. The portable, length-adjustable, and resistance adjustable exercise device of claim 1, wherein said rectangular-parallelepiped-shaped block of said main base has:

a) a lower surface;

b) an upper surface;

c) a pair of axial side surfaces; and d) a pair of lateral side surfaces.

3. The portable, length-adjustable, and resistance adjustable exercise device of claim 2, wherein said rectangular-parallelepiped-shaped block of said main base has a pair of through bores.

4. The portable, length-adjustable, and resistance adjustable exercise device of claim 3, wherein said pair of through bores of said rectangular-parallelepiped-shaped block of said main base are parallel to each other.

5. The portable, length-adjustable, and resistance adjustable exercise device of claim 3, wherein said pair of through bores of said rectangular-parallelepiped-shaped block of said main base extend axially therethrough.

6. The portable, length-adjustable, and resistance adjustable exercise device of claim 3, wherein said pair of through bores of said rectangular-parallelepiped-shaped block of said main base extend in close proximity to said pair of axial side surfaces of said rectangular-parallelepiped-shaped block of said main base.

7. The portable, length-adjustable, and resistance adjustable exercise device of claim 3, wherein said pair of through bores of said rectangular-parallelepiped-shaped block of said main base extend in close proximity to said lower surface of said rectangular-parallelepiped-shaped block of said main base.

8. The portable, length-adjustable, and resistance adjustable exercise device of claim 3, wherein said pair of through bores of said rectangular-parallelepiped-shaped block of said main base are parallel to said pair of axial side surfaces of said rectangular-parallelepiped-shaped block of said main base.

9. The portable, length-adjustable, and resistance adjustable exercise device of claim 3, wherein said pair of through bores of said rectangular-parallelepiped-shaped block of said main base are parallel to said lower surface of said rectangular-parallelepiped-shaped block of said main base.

10. The portable, length-adjustable, and resistance adjustable exercise device of claim 3, wherein said rectangular-parallelepiped-shaped block of said main base has two pair of threaded blind bores.

11. The portable, length-adjustable, and resistance adjustable exercise device of claim 10, wherein said two pair of threaded blind bores of said rectangular-parallelepiped-shaped block of said main base are parallel to each other.

12. The portable, length-adjustable, and resistance adjustable exercise device of claim 10, wherein said two pair of threaded blind bores of said rectangular-parallelepiped-shaped block of said main base extend laterally into said pair of axial side surfaces of said rectangular-parallelepiped-shaped block of said main base, respectively.

13. The portable, length-adjustable, and resistance adjustable exercise device of claim 10, wherein each associated pair of said two pair of threaded blind bores of said rectangular-parallelepiped-shaped block of said main base are collinear.

14. The portable, length-adjustable, and resistance adjustable exercise device of claim 10, wherein said two pair of threaded blind bores of said rectangular-parallelepiped-shaped block of said main base communicate with said pair of through bores of said rectangular-parallelepiped-shaped block of said main base, respectively.

15. The portable, length-adjustable, and resistance adjustable exercise device of claim 2, wherein said main base comprises a skid-resistant pad.

16. The portable, length-adjustable, and resistance adjustable exercise device of claim 15, wherein said skid-resistant pad of said main base overlies said upper surface of said rectangular-parallelepiped-shaped block of said main base; and wherein said skid-resistant pad of said main base is for increasing grip of the foot of the user thereon.

17. The portable, length-adjustable, and resistance adjustable exercise device of claim 10, wherein said main base comprises two pair of rail rods.

18. The portable, length-adjustable, and resistance adjustable exercise device of claim 17, wherein said two pair of rail rods of said main base are straight.

19. The portable, length-adjustable, and resistance adjustable exercise device of claim 17, wherein said two pair of rail rods of said main base are slender.

20. The portable, length-adjustable, and resistance adjustable exercise device of claim 17, wherein said two pair of rail rods of said main base are elongated.

21. The portable, length-adjustable, and resistance adjustable exercise device of claim 17, wherein said two pair of rail rods of said main base move readily in said pair of through bores of said rectangular-parallelepiped-shaped block of said main base, respectively.

22. The portable, length-adjustable, and resistance adjustable exercise device of claim 17, wherein said main base two pair of bolts.

23. The portable, length-adjustable, and resistance adjustable exercise device of claim 22, wherein said two pair of bolts of said main base thread into said two pair of threaded blind bores of said rectangular-parallelepiped-shaped block of said main base, respectively.

24. A portable, length-adjustable, and resistance adjustable exercise device for allowing exercising of both feet of a user simultaneously without having to have the feet of the user physically attached thereto, for using weight of the user for activating resistance, and for allowing the feet of the user to be positioned in front of each other during exercising both feet simultaneously so as to work in opposition to each other by working the toe portion of one foot of the user simultaneously with the heel portion of the other foot of the user, said portable, length-adjustable, and resistance adjustable exercise device comprising:

a) a main base; and b) a pair of resistance members;

wherein said main base is for resting on a support surface;

wherein said pair of resistance members are replaceably attached to said main base for allowing said portable, length-adjustable, and resistance adjustable exercise device to be portable;

wherein said pair of resistance members are length adjustably attached to said main base for allowing said portable, length-adjustable, and resistance adjustable exercise device to be length adjustable;

wherein said pair of resistance members are resistance adjustable for allowing said portable, length-adjustable, and resistance adjustable exercise device to be resistance adjustable;

wherein said pair of resistance members are for allowing exercising of both feet of the user simultaneously without having to have the feet of the user physically attached thereto;

wherein said pair of resistance members are for activating by the weight of the user; and wherein said pair of resistance members are disposed on opposite sides of said main base for allowing the feet of the user to be positioned in front of each other during exercising both feet simultaneously so as to work in opposition to each other by working the toe portion of the one foot of the user simultaneously with the heel portion of the other foot of the user, wherein said pair of resistance members straddle said main base.

25. The portable, length-adjustable, and resistance adjustable exercise device of claim 2, wherein said pair of resistance members are adjacent to said pair of lateral side surfaces of said rectangular-parallelepiped-shaped block of said main base, respectively.

26. The portable, length-adjustable, and resistance adjustable exercise device of claim 22, wherein each resistance member comprises an auxiliary base.

27. The portable, length-adjustable, and resistance adjustable exercise device of claim 26, wherein said auxiliary base of each resistance member is a rectangular-parallelepiped-shaped block.

28. The portable, length-adjustable, and resistance adjustable exercise device of claim 27, wherein said rectangular-parallelepiped-shaped block of said auxiliary base of each resistance member has:

a) a lower surface;

b) an upper surface;

c) a pair of axial side surfaces; and d) a pair of lateral side surfaces; and wherein said lower surface of said rectangular-parallelepiped-shaped block of said auxiliary base of each resistance member is for resting on the support surface.

29. The portable, length-adjustable, and resistance adjustable exercise device of claim 28, wherein said rectangular-parallelepiped-shaped block of said auxiliary base of each resistance member has a pair of blind bores.

30. The portable, length-adjustable, and resistance adjustable exercise device of claim 29, wherein said pair of blind bores of said rectangular-parallelepiped-shaped block of said auxiliary base of each resistance member are parallel to each other.

31. The portable, length-adjustable, and resistance adjustable exercise device of claim 29, wherein said pair of blind bores of said rectangular-parallelepiped-shaped block of said auxiliary base of each resistance member extend axially therein from a respective lateral side surface of said rectangular-parallelepiped-shaped block of said auxiliary base of an associated resistance member.

32. The portable, length-adjustable, and resistance adjustable exercise device of claim 29, wherein said pair of blind bores of said rectangular-parallelepiped-shaped block of said auxiliary base of each resistance member are in close proximity to said pair of axial side surfaces of said rectangular-parallelepiped-shaped block of said auxiliary base of an associated resistance member.

33. The portable, length-adjustable, and resistance adjustable exercise device of claim 29, wherein said pair of blind bores of said rectangular-parallelepiped-shaped block of said auxiliary base of each resistance member are in close proximity to said lower surface of said rectangular-parallelepiped-shaped block of said auxiliary base of said associated resistance member.

34. The portable, length-adjustable, and resistance adjustable exercise device of claim 29, wherein said pair of blind bores of said rectangular-parallelepiped-shaped block of said auxiliary base of each resistance member are parallel to said pair of axial side surfaces of said rectangular-parallelepiped-shaped block of said auxiliary base of an associated resistance member.

35. The portable, length-adjustable, and resistance adjustable exercise device of claim 29, wherein said pair of blind bores of said rectangular-parallelepiped-shaped block of said auxiliary base of each resistance member are parallel to said lower surface of said rectangular-parallelepiped-shaped block of said auxiliary base of an associated resistance member.

36. The portable, length-adjustable, and resistance adjustable exercise device of claim 29, wherein said pair of blind bores of said rectangular-parallelepiped-shaped block of said auxiliary base of each resistance member align with said pair of through bores of said rectangular-parallelepiped-shaped block of said main base, respectively.

37. The portable, length-adjustable, and resistance adjustable exercise device of claim 29, wherein said pair of blind bores of said rectangular-parallelepiped-shaped block of said auxiliary base of each resistance member slidingly receive said two pair of rail rods of said main base, respectively, so as to allow said pair of resistance members to move relative to said main base so as to allow said portable, length-adjustable, and resistance adjustable exercise device to be length adjustable.

38. The portable, length-adjustable, and resistance adjustable exercise device of claim 28, wherein each resistance member comprises three coil spring assemblies.

39. The portable, length-adjustable, and resistance adjustable exercise device of claim 38, wherein said three coil spring assemblies of each resistance member extend vertically upwardly from said upper surface of said rectangular-parallelepiped-shaped block of said auxiliary base of an associated resistance member to terminators.

40. The portable, length-adjustable, and resistance adjustable exercise device of claim 39, wherein each resistance member comprises a platform; and wherein said platform of each resistance member is for working the toe portion of a foot of the user or the heel portion of the foot of the user.

41. The portable, length-adjustable, and resistance adjustable exercise device of claim 40, wherein said platform of each resistance member comprises a thin block.

42. The portable, length-adjustable, and resistance adjustable exercise device of claim 41, wherein said thin block of said platform of each resistance member is disposed on said terminators of said three coil spring assemblies of an associated resistance member.

43. The portable, length-adjustable, and resistance adjustable exercise device of claim 41, wherein said platform of each resistance member comprises a skid-resistant pad; and wherein said skid-resistant pad of said platform of each resistance member for increasing grip of the foot of the user thereon.

44. The portable, length-adjustable, and resistance adjustable exercise device of claim 43, wherein said thin block of said platform of each resistance member has an upper surface; and wherein said skid-resistant pad of said platform of each resistance member overlies said upper surface of said thin block of said platform of an associated resistance member.

45. The portable, length-adjustable, and resistance adjustable exercise device of claim 29, wherein said two pair of bolts of said main base tighten down in said two pair of threaded blind bores of said rectangular-parallelepiped-shaped block of said main base, respectively, onto said two pair of rail rods of said main base, respectively, so as to maintain said two pair of rail rods of said main base at a predetermined position for allowing said portable, length-adjustable, and resistance adjustable exercise device to be length adjustable.

46. The portable, length-adjustable, and resistance adjustable exercise device of claim 41, wherein each coil spring assembly of each resistance member comprises a coil spring.

47. The portable, length-adjustable, and resistance adjustable exercise device of claim 46, wherein each coil spring assembly of each resistance member comprises a lower seat.

48. The portable, length-adjustable, and resistance adjustable exercise device of claim 47, wherein said lower seat of each coil spring assembly of each resistance member is attached to said upper surface of said rectangular-parallelepiped-shaped block of said auxiliary base of an associated resistance member.

49. The portable, length-adjustable, and resistance adjustable exercise device of claim 47, wherein said lower seat of each coil spring assembly of each resistance member is attached to said upper surface of said rectangular-parallelepiped-shaped block of said auxiliary base of an associated resistance member by screws.

50. The portable, length-adjustable, and resistance adjustable exercise device of claim 47, wherein said coil spring of each coil spring assembly of each resistance member sits in said lower seat of an associated coil spring assembly of an associated resistance member.

51. The portable, length-adjustable, and resistance adjustable exercise device of claim 47, wherein each coil spring assembly of each resistance member comprises an upper seat.

52. The portable, length-adjustable, and resistance adjustable exercise device of claim 51, wherein said upper seat of each coil spring assembly of each resistance member is attached to said thin block of said platform of an associated resistance member.

53. The portable, length-adjustable, and resistance adjustable exercise device of claim 51, wherein said upper seat of each coil spring assembly of each resistance member is attached to said thin block of said platform of an associated resistance member by screws.

54. The portable, length-adjustable, and resistance adjustable exercise device of claim 51, wherein said upper seat of each coil spring assembly of each resistance member caps off said coil spring of an associated coil spring assembly of an associated resistance member.

55. The portable, length-adjustable, and resistance adjustable exercise device of claim 51, wherein each coil spring assembly of each resistance member comprises a stem.

56. The portable, length-adjustable, and resistance adjustable exercise device of claim 55, wherein said stem of each coil spring assembly of each resistance member extends vertically upwardly through said rectangular-parallelepiped-shaped block of said auxiliary base of an associated resistance member, through said lower seat of an associated coil spring assembly of said associated resistance member, through said coil spring of said associated coil spring assembly of said associated resistance member, and into said upper seat of said associated coil spring assembly of said associated resistance member.

* * * * *